US005153092A

United States Patent [19]

Kao et al.

[11] Patent Number: 5,153,092

[45] Date of Patent: Oct. 6, 1992

[54] PROCESSES FOR ENCAPSULATED TONERS

[75] Inventors: Sheau V. Kao; Gerald R. Allison, Oakville; Michael S. Hawkins, Mississauga; Hadi K. Mahabadi, Toronto, all of Canada

[73] Assignee: Xerox Corporation, Stamford, Conn.

[21] Appl. No.: 646,914

[22] Filed: Jan. 28, 1991

[51] Int. Cl.[5] ..... G03G 9/093

[52] U.S. Cl. ..... 430/137; 430/110; 430/138; 264/7

[58] Field of Search ..... 430/137, 110, 138; 264/7

[56] References Cited

U.S. PATENT DOCUMENTS

| | | | |
|---|---|---|---|
| 4,272,010 | 2/1988 | Shin et al. | 430/109 |
| 4,937,167 | 6/1990 | Moffat et al. | 430/137 |
| 4,599,294 | 7/1986 | Matsumoto et al. | 430/137 |
| 4,636,451 | 1/1987 | Matkin et al. | 430/109 |
| 4,699,866 | 10/1987 | Naoi et al. | 430/138 |
| 4,725,522 | 2/1988 | Breton et al. | 430/138 |
| 4,762,765 | 8/1988 | Nied et al. | 430/137 |
| 4,784,930 | 11/1988 | Hatakeyama | 430/138 |
| 4,877,706 | 10/1989 | Mahabadi et al. | 430/106.6 |
| 4,935,327 | 6/1990 | Takizawa et al. | 430/109 |
| 5,043,240 | 8/1991 | Ong et al. | 430/137 |

*Primary Examiner*—Marion E. McCamish
*Assistant Examiner*—C. D. RoDee
*Attorney, Agent, or Firm*—Eugene O. Palazzo; Zosan S. Soong

[57] ABSTRACT

A process for the preparation of encapsulated toners which comprises blending core momomer or monomers, free radical initiator, pigment, and an oil soluble shell monomer; dispersing the resulting mixture in a stabilized aqueous suspension; thereafter subjecting the stabilized droplets to a shell forming interfacial polycondensation reaction by adding a water soluble shell monomer or monomers; subsequently forming the core resin binder by heat induced free radical polymerization within the newly formed capsules; washing the toner suspension; subsequently removing water therefrom in a fluidized bed dryer to obtain a dry encapsulated toner with a surface moisture content of about 0.3 percent by weight to about 0.8 percent by weight; and thereafter blending the encapsulated toner with surface additives.

29 Claims, No Drawings

PROCESSES FOR ENCAPSULATED TONERS

BACKGROUND OF THE INVENTION

The present invention is generally directed to processes for the preparation of encapsulated toners, and more specifically to in situ processes for the preparation of encapsulated toner compositions, wherein the toner particles can be formed in an aqueous medium, recovered from the aqueous medium in the form of a dry powder and then surface treated to impart electrical, release, flow and other desirable toner properties. More specifically, the present invention is directed to the treatment of known encapsulated toner compositions wherein a pressure fixable soft core is enclosed by a pressure rupturable hard shell after one or more reaction steps in an aqueous medium. In one embodiment of the present invention there are provided processes for the drying, that is for example removal of residual water, from encapsulated toners or toner cakes, in economical conventional drying devices, such as a fluidized bed dryer or a vacuum dryer, and the subsequent surface coating thereof in, for example, a high shear blending device with additives which can assist in enhancing the toner imaging performance, and provide conductive encapsulated toners. Moreover, with the process of the present invention in embodiments thereof the use of costly graphites can be avoided, rather known conductive carbon blacks, such as CARBON BLACK BP (black pearls) 2000 TM available from Cabot Corporation, and the like can be selected. In the known costly spray drying processes for the preparation of encapsulated toners there is usually introduced into a hot air stream, through a nozzle or a disc atomizer, an aqueous suspension of the appropriate solid particles that will provide an encapsulated toner with a surface coating substance, such as certain graphites like AQUADAG E ®, and whereby substantial water, for example from about 60 to about 70 percent, is evaporated to enable the encapsulated toner. A number of advantages are associated with the processes of the present invention in embodiments thereof, such as lower thermal energy consumption, for example, there is utilized heated air at lower temperatures, since less water, 10 percent for example, has to be removed during the drying step; and the process is more economical in that, for example, surface additives such as carbon black, or certain powdered forms of graphite can be utilized as the surface additives.

The drying and dry blending processes of the present invention in an embodiment relates to the preparation of encapsulated toners, including in situ toners with surface additives of carbon black and metal salts of fatty acids, such as zinc stearate. A number of processes for the preparation of encapsulated toners are known. For example, a toner encapsulation process is illustrated in U.S. Pat. Nos. 4,727,011 and 4,877,706, the disclosures of which are totally incorporated herein by reference, which processes comprise, for example, 1) mixing a blend of a core monomer or monomers, free radical chemical initiator, pigment, and an oil soluble shell monomer; 2) dispersing the resulting mixture in a stabilized aqueous suspension; 3) thereafter subjecting the stabilized droplets to a shell forming interfacial polycondensation reaction by adding a water soluble shell monomer or monomers; 4) subsequently forming the core resin binder by heat induced free radical polymerization within the newly formed capsules; 5) washing the toner suspension to remove the surfactant in a filtration or centrifuging step; 6) diluting the resulting toner concentrates with water and adding a conductive colloidal graphite to the toner suspension prior to spray drying; 7) recovering the toner in a spray drying process; and 8) blending the recovered toner with conductive additive, release additive and flow aid. Another toner encapsulation process is described in U.S. Pat. No. 4,725,522, the disclosure of which is totally incorporated herein by reference, which substitutes the aforementioned first four steps with 1) dispersing pigment and magnetite in an organic solution of an elastomer; 2) adding shell monomers; 3) dispersing the resulting mixture in water containing a surfactant stabilizer; and 4) subsequently heating the reaction mixture to enable hydrolysis and an interfacial polymerization reaction thereby allowing the formation of a hard shell. These toner encapsulation processes employ a spray drying method to recover the toner from an aqueous suspension and to produce a free flowing toner powder. In U.S. Pat. No. 4,877,706 a conductive encapsulated toner composition is prepared by spray drying the toner suspension after adding a conductive component such as AQUADAG E® (Acheson Colloids Ltd.), a specially prepared water based dispersion of conductive colloidal graphite and a polymeric binder. The resulting toner may contain a layer of conductive graphite or carbon black uniformly and completely covering its surface. After drying, the toner is blended with a conductive additive, release additive or flow aid to produce a toner with a volume resistivity of about $1\times10^3$ to about $1\times10^8$ ohm-cm, and preferably from about $5\times10^4$ to about $1\times10^7$ ohm-cm, measurable in a 1 $cm^3$ cell test fixture at 10 volts.

Spray drying is commonly employed to separate solid toner particles from an aqueous medium in many encapsulated toner processes. In one application, a toner suspension can be fed directly to a spray dryer to result in a free flowing powder. When toner washing is required to remove surfactant, the toner concentrate after filtration can be diluted and then fed to a spray dryer. As described in the prior art, a conductive coating can conveniently be applied to toner particles via the spray drying process. Economically, however, the spray drying process represents an expensive manufacturing method in comparison to other drying processes such as fluidized bed drying and vacuum drying. Typically, in spray drying processes a suspension containing 30 percent by weight of solid precursor toner particles is fed into a spray dryer. Thus, for every 3 parts of toner recovered 7 parts of water will have to be evaporated. With the fluidized bed drying or vacuum drying of the present invention in embodiments, a toner concentrate containing about 85 percent by weight of solid encapsulated toner particles are dried providing a toner to water weight ratio of approximately 5.7 parts to 1 part. The extra thermal energy required to evaporate water can render spray drying a more costly approach from, for example, a manufacturing point of view. In addition, for the same production capacity the physical dimensions of a spray dryer are much larger than either a fluidized bed dryer or a vacuum dryer, thereby adding to the capital inventment costs. Therefore, there is a need for replacing spray drying processes with more economical drying processes, such as fluidized bed drying, and a need for processes enabling the effective blending of additives, such as charge control agents, and the like to toners prepared by the drying methods indicated herein.

In a patentability search report there were recited the following U.S. Pat. Nos. 4,699,866 which discloses a process for the preparation of encapsulated toners followed by spray drying and heating; the heating can be accomplished in a fluid bed apparatus; U.S. Pat. No. 4,784,930 which discloses a process for the preparation of encapsulated toners wherein spray drying and heat drying in, for example, a fluid bed dryer and an infrared dryer are selected; U.S. Pat. No. 4,636,451 which discloses a process for the preparation of encapsulated toners wherein water removal is effected by spray drying, air drying, vacuum evaporation, centrifugal separation, and the like; and U.S. Pat. No. 4,599,294 which discloses a means for the drying of particulate materials, such as carbon black.

The in situ toner obtained with the processes of the present invention can be selected for a variety of known reprographic imaging processes including electrophotographic and ionographic processes. In one embodiment, the encapsulated toner can be selected for pressure fixing processes wherein the image is fixed with pressure. Pressure fixing is common in ionographic processes in which latent images are generated on a dielectric receiver, such as silicon carbide, reference U.S. Pat. No. 4,885,220, the disclosure of which is totally incorporated herein by reference. The latent images can then be toned with a conductive encapsulated toner by inductive single component development, and transferred and fixed simultaneously (transfix) in one single step onto paper with pressure. In another embodiment, the toner compositions can be utilized in xerographic imaging apparatus wherein image toning and transfer are accomplished electrostatically, and transferred images are fixed in a separate step by means of a pressure roll with or without the assistance of thermal or photochemical energy fusing. Also, an encapsulated toner obtained with the processes of the present invention can be selected, it is believed, for magnetic image character recognition (MICR) processes, reference U.S. Pat. No. 4,517,268 and U.S. Pat. No. 33,172, the disclosures of which are totally incorporated herein by reference.

In situ toners usually require surface additives such as charge control agents, release components, and flow aid materials. For example, one application of an encapsulated toner is in the known inductive single component development process. The toner material used in these processes usually possess high electrical conductivity at the outer surface of the toner particles. For example, for commercial ionographic printers such as Delphax S 9000 TM, S 6000 TM, S 4500 TM, S 3000 TM, Xerox 4060 TM and Xerox 4075 TM toners with a resistivity (the inverse of conductivity) of from about $1\times10^3$ to $1\times$about $10^8$, and preferably from about $5\times10^4$ to about $1\times10^7$ ohm-cm, are selected. For encapsulated toner with a polyurea shell as described in, for example, U.S. Pat. No. 4,877,706, the disclosure of which is totally incorporated herein by reference, the toner without any additive coating has an electrically insulating surface. According to the teaching of this patent, the addition of certain colloidal graphite coatings on the toner surface during spray drying reduces the toner resistivity from about $10^{13}$ ohm-cm to about $10^4$ ohm-cm. Conductive carbon black and nonconductive release agent can be subsequently added to the encapsulated toner in a dry blending process to provide the toner with a resistivity of, for example, $5\times10^4$ to $1\times10^7$ ohm-cm. Thus, dry blending can be considered an important step in controlling the toner surface properties, which properties are of importance to print quality in, for example, xerographic copiers and printers.

Although the spray drying process is capable of producing a free flowing powder from a toner suspension, there remains a need for a simple, economical drying process for recovering in situ encapsulated toner compositions, wherein the toner particles are prepared in an aqueous phase. There is a need for an economical encapsulated toner manufacturing process wherein, for example, lower capital investment and operating cost are associated therewith as compared to present drying processes; for example, the capital cost saving can be up to about $1,000,000 annually when producing from about 1 to about 10 million pounds of toner with the operating cost saving being about 50 cents per pound of toner in some embodiments. There is also a need for processes that enable the coating of encapsulated toners with additives thereon that control the functional properties of the toner. There is also a need for processes wherein economical surface additives such as carbon black are applied in a simple dry blending operation, and wherein the need for surface coating during drying can be avoided.

SUMMARY OF THE INVENTION

A feature of the present invention is to provide a low cost process for the preparation of a free flowing encapsulated toner powder from a toner suspension by fluidized bed drying or vacuum drying.

Another feature of the present invention is to provide an encapsulated toner dry blending process wherein the additives are coated onto the toner surface in a single operation.

A further feature of the present invention is to provide a low cost process for producing a toner with desirable and stable electrical, release and flow properties.

A further feature of the present invention is to provide a low cost process for providing a toner with excellent developing characteristics.

The above and other features of the present invention can be accomplished by drying a toner concentrate, or cakes of known encapsulated toner compositions in a fluidized bed dryer or a vacuum dryer for an effective period of time to obtain an encapsulated dry toner having a surface moisture content of from about 0.3 weight percent to about 0.8 weight percent; and subsequently coating the recovered encapsulated dry toner particles with various additives sequentially in a blender or mixer equipped with means to homogenize the toner powder, and a high speed agitating device to enable attachment of the additives to the toner particle surface.

The present invention in an embodiment is directed to processes for the preparation of encapsulated toners that can be selected for known cold pressure fixable, and single component image development processes. An illustrative process for the preparation of the encapsulated toner particles employed for the process of the present invention is described in U.S. Pat. No. 4,727,011, the disclosure of which is totally incorporated herein by reference, which process involves the dispersion of a magnetic colorant in a mixture of hydrophobic liquids, such as a polyisocyanate, a core monomer and an initiator; subsequent dispersion of the above pigmented organic medium in an aqueous medium containing a hydrophilic protective colloid. thereby generating a stable particle suspension; adding a water soluble shell component to generate a shell around the core material particles; and heating of the reaction mixture to polymerize the core monomer. Subsequently, the encapsulated toner can be washed with water in a separation apparatus, such as a filter or a centrifuge, to remove any unreacted water soluble shell component and protective colloid. A toner concentrate in the form of wet cakes is obtained after separation. These toner cakes are then suitable for the subsequent drying procedure illustrated herein. According to one embodiment of the '706 patent, a conductive encapsulated toner composition can be prepared by diluting the aforementioned toner cakes with water and then spray drying the toner suspension together with a conductive component such as AQUADAG E® (Acheson Colloids Ltd.). The conductive encapsulated toner produced has a volume resistivity of, for example, about $10^4$ ohm-cm. One feature of the present invention as applied, for example, to a cold pressure fixable encapsulated toner is the selection of the less costly, as compared for example to oxides, and the like, carbon black only as the conductivity control agent, which carbon black is added to the prepared encapsulated toner surface by dry blending alone.

According to one embodiment of the present invention, a fluidized bed dryer is used in place of a spray dryer. Typically, a known fluidized bed dryer, such as those available from Dairy Equipment Company, Glatt Air Techniques, Inc., and Niro Atomizer Inc. includes an air distribution device, a product container below an expansion chamber, and filter bags. The fluidized bed dryer uses heated, for example, from about 50° to about 200° C., air to fluidize the solid encapsulated particles and remove the residual moisture from those particles. In a drying operation, the toner cakes obtained after the washing and filtration step can be charged into the fluidized bed dryer directly. These toner cakes contain less than approximately 15 percent by weight of water as compared to 70 percent by weight of water in a toner suspension fed to a spray dryer. Thus, for example, in a fluidized bed dryer 0.18 kilogram of water can be evaporated for every kilogram of toner recovered, whereas 2.33 killigrams of water is usually evaporated for every kilogram of toner in the spray dryer method, therefore, substantially less thermal energy is needed for the processes of the present invention.

The length of time the encapsulated toner particles are subjected to drying can be of value for the subsequent toner dry blending operation with additives. The length of drying determines the amount of residual moisture on the toner surface. As the toner particles become extremely dry the coating of conductive additives, such as carbon black, in the subsequent dry blending operation may not be effective. As a result, the control of conductivity ($1\times10^{-8}$ to $1\times10^{-3}$ mho $cm^{-1}$) of the toner, which is important in inductive development, will be very difficult. In contrast, there is no problem in attaching carbon black onto an encapsulated toner surface previously coated with AQUADAG E® by spray drying. It is believed that AQUADAG E® coating facilitates the subsequent attachment of carbon black in the dry blending operation. Another problem associated with overdrying is that the toner tends to form hard agglomerates as it becomes extremely dry causing it to lose free flowing characteristics. The percent residual moisture on the toner particle surface can be determined, for example, using a Karl Fischer coulometer with oven, model 684/688 available from Metrohm Inc.. An optimal amount of surface moisture for an encapsulated toner with, for example, a polyurea shell can be from about 0.3 percent to about 0.8 percent. The drying time accordingly depends upon the operating parameters such as the weight of toner, air flow rate, and air temperature; this time in an embodiment of the present invention is from about 10 to about 20 minutes.

A high shear blending apparatus can be selected for additive coating after the toner particles are dried. More specifically, the type of blender or mixer selected for the present invention has provision for imparting a high speed agitation and shearing zone within the mixture of toner and additives, and a provision for transporting the toner-additive mixture into this high speed agitation zone. One example of a blender suitable for the present invention is a Lightnin Labmaster blender (General Signal) wherein a high speed impeller is located inside a cylindrical container. The cylindrical container provides the mixture with a tumbling motion at a low speed, for example at 30 turns per minute. Another blender example is a Littleford FM50 mixer (Littleford Bros., Inc.) which uses low speed plows to fluidize the mixture and high speed choppers to impart intensive agitation. The dry blending operation is preferably carried out in several steps. In one embodiment of the present invention, the conductive carbon black is introduced and blended for several minutes. Then a release additive like zinc stearate is added and the resulting mixture is blended until the desired toner conductivity is obtained. A sequential blending operation will enable better attachment of the additives to the toner particle surface and provide toner with a more stable conductivity.

A sequential blending operation was found to be of importance in attaching various additives to the toner particle surface and imparting it with desirable performance enabling properties. In one embodiment of the present invention carbon black was selected for enhancing toner conductivity, and a zinc stearate was selected for enhancing toner release. The carbon black is preferably introduced first and the carbon black toner mixture blended for several minutes at a high agitating speed. This approach will allow a large portion of carbon black particles to be attached to the toner particle surface. At the end of this first blending operation the toner resistivity drops usually to between $1\times10^2$ and $5\times10^3$ ohm-cm. To this mixture is then added a release aid additive, such as zinc stearate, and blending continues at a relatively lower agitating speed until the desired toner resistivity is obtained. In a typical resistivity time plot, the resistivity rises sharply from about $1\times10^2$ to $5\times10^3$ ohm-cm to about $1\times10^4$ to about $1\times10^5$ ohm-cm immediately following the introduction of the nonconductive zinc stearate. Typically, the resistivity will then stabilize at about $1\times10^4$ to about $1\times10^5$ ohm-cm for about 2 minutes before it starts to increase to about $1\times10^5$ to about $1\times10^8$ ohm-cm. The shoulder region (where resistivity is stabilized) in a resistivity time plot is probably due to the further attachment of carbon black particles to the toner surface. The encapsulated toner prepared in accordance with the aforementioned sequence can possess very stable, for example, the toner resistivity remains substantially constant under agitation for one hour at 1,000 RPM, electrical characteristics in a xerographic development housing, such as the Xerox Corporation 5900 TM development apparatus housing.

Blending operations in which carbon black and zinc stearate are introduced simultaneously or in reverse order can result in encapsulated toners with less desirable stable electrical characteristics.

A highly conductive pigment, such as a conductive carbon black, is added to the toner to form a surface coating which changes the toner from electrically insulative to somewhat conductive. The conductive carbon black will generally have a particle size ranging from about 10 nanometers to about 100 nanometers and can be added to toner in various effective amounts, such as from about 0.2 to 3.0 percent, and preferably from 0.5 to 1.5 percent by weight based on the total weight of the toner. Large agglomerates of carbon black often found in commercial carbon black products are preferably eliminated prior to coating them onto the toner. This can be accomplished by subjecting the carbon black agglomerates to a high speed mixing action or using a commercially available nonagglomerated carbon black. The carbon black imparts a resistivity to the toner of, for example, from about $10^2$ ohm-cm to about $1\times10^4$ ohm-cm, and preferably $10^3$ ohm-cm to $5\times10^3$ ohm-cm. Typical conductive carbon blacks suitable for use in the present invention include BLACK PEARLS 2000 TM and VULCAN TM XC-72R, both commercially available from Cabot Corporation.

Metal salts of fatty acids are selected primarily to impart release characteristics to the toner particles, thus preventing or minimizing sticking thereof to the surface of xerographic development rolls. Commercially available metal salts of fatty acids such as zinc sterate and magnesium stearate were found to produce excellent release of the encapsulated toner. Examples of zinc stearate are Type L TM, D TM and Metasap 82 TM and magnesium stearate 90 TM, all available from Synthetic Products Company. These metal salts of fatty acids preferably have a particle size (average particle diameter) of from about 1 micron to about 30 microns, and preferably from about 1 micron to about 15 microns. The amount of metal salts of fatty acids added is preferably from about 0.5 percent to about 5 percent based on the total weight of toner, and more preferably from about 0.5 percent to about 2.5 percent. Also, the addition of the carbon black provides toners with excellent free flowing characteristics. Optionally, particulate flow aids can be included on the toner for further flow improvement. Examples of the aforementioned flow agents that may be selected are AEROSILS TM, reference U.S. Pat. No. 3,900,588, the disclousure of which is totally incorporated herein by reference, such as AEROSIL TM R972, AEROSIL TM R974, and the like, available from Degussa Inc. The amount of AEROSIL TM used as flow agent is, for example, from about 0.2 to 2 percent based on the weight of the toner, and more preferably from about 0.2 to about 1.0 percent.

In one embodiment, the process of the present invention comprises the preparation of known encapsulated toners, reference a number of the U.S. patents mentioned herein, with carbon black on the surface thereof which process comprises 1) mixing a blend of a core monomer or monomers, up to 5 for example, free radical chemical initiator, pigment, and an oil soluble shell monomer; 2) dispersing the resulting mixture in a stabilized aqueous suspension; 3) thereafter subjecting the stabilized droplets to a shell forming interfacial polycondensation reaction by adding a water soluble shell monomer or monomers; 4) subsequently forming the core resin binder by heat induced free radical polymerization within the newly formed capsules; 5) washing the toner suspension to remove the surfactant in a filtration or centrifuging step to obtain a toner concentrate containing less than about 15 percent of water; 6) removing the water to produce a dry toner in a fluidized bed dryer by the utilization of air heated to from about 50° to about 200° C. to obtain an encapsulated toner with a residual moisture of from about 0.3 percent to about 0.8 percent; and 8) blending the recovered toner sequentially with a conductive carbon black additive, release additive, such as zinc stearate, and flow aid, such as AEROSIL TM R972 to obtain a toner with resistivity of from about $1\times10^3$ to about $1\times10^8$ ohm-cm. Further, other known encapsulated toners can be treated with the process of the present invention, reference for example copending applications U.S. Ser. No. 524,946; U.S. Ser. No. 561,397; and U.S. Ser. No. 575,747, the disclosures of which are totally incorporated herein by reference; and the United States patents mentioned in the copending applications, the disclosures of which are totally incorporated herein by reference.

Examples of core monomers selected in known effective amounts include, but are not limited to, addition-type monomers such as acrylates, methacrylates, and the like including propyl acrylate, isopropyl acrylate, propyl methacrylate, n-butyl acrylate, s-butyl acrylate, isobutyl acrylate, butyl methacrylate, s-butyl methacrylate, isobutyl methacrylate, pentyl acrylate, pentyl methacrylate, benzyl acrylate, benzyl methacrylate, hexyl acrylate, cyclohexyl acrylate, hexyl methacrylate, cyclohexyl methacrylate, lauryl acrylate, lauryl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, tolyl acrylate, tolyl methacrylate, styrene, dodecyl styrene, hexyl methyl styrene, nonyl styrene, tetradecyl styrene, other substantially equivalent addition monomers, and mixtures thereof.

Various known pigments or mixtures thereof in known effective amounts can be selected including carbon black, magnetic pigments, such as Mobay magnetites MO8029 TM, MO8060 TM, Columbian magnetites, Mapico Blacks and surface treated magnetites, Pfizer magnetites CB4799 TM, CB5300 TM, CB5600 TM, MCX6369 TM, Bayer magnetites, Bayferrox 8600 TM, 8610 TM, Northern Pigments magnetites NP-604 TM, NP-608 TM, Magnox magnetites TMB-100 TM or TMB-104 TM, and other equivalent black pigments. As colored pigments there can be selected Heliogen Blue, Pylam Oil Blue, Pylam Oil Yellow, Pigment Blue, Pigment Violet, Pigment Red, Lemon Chrome Yellow, Bon Red, NOVAperm Yellow FGL, Hostaperm Pink, 2,9-dimethyl-substituted quinacridone, Dispersed Red, Solvent Red, copper tetra-(octadecyl sulfonamido) phthalocyanine, copper phthalocyanine, diarylide yellow 3,3-dichlorobenzidene acetoacetanilides, a nitrophenyl amine sulfonamide, Dispersed Yellow, 2,5-dimethoxy-4-sulfonanilide phenylazo-4'-chloro-2,5-dimethoxy acetoacetanilide, and Permanent Yellow FGL.

Examples of typical shell polymers include polyureas, polyamides, polyesters, polyurethanes, liquid crystalline thermotropic polymer and mixtures thereof, and other similar polycondensation products selected in known effective amounts.

The following Examples are being submitted to further define various species of the present invention. These Examples are intended to be illustrative only and are not intended to limit the scope of the present invention. Comparative information is also presented.

EXAMPLE I

An encapsulated single component development cold pressure fixable toner composition was prepared as follows: 13.68 killigrams of lauryl methacrylate (ROCRYL TM 320, Rohm and Hass Company), 5.37 killigrams of toluene diisocyanate, 2.42 killigrams of tris(p-isocyanatophenyl)-thiophosphate (DESMODUR TM RF in methylene chloride available from Mobay Chemical Company) and 242.3 grams of 2,2'-azobis-(isobutyronitrile) initiator (VAZO TM 64, E.I. du Pont de Nemours & Company, Inc.) were added to a 50 gallon reaction vessel and homogenized with an IKA rotor-stator mixer (Model T115/4) at room temperature, 25° C., for 1.5 minutes at 3,600 revolutions per minute (rpm). Into this mixture was dispersed 35.5 killigrams of the magnetite magnetic iron oxide ($Fe_3O_4$, MO-8029, commercially available from Pfizer Pigments Inc.) with the IKA mixer at 3,600 rpm and a scrapper blade agitated at 40 rpm for 3 minutes at room temperature to obtain a homogeneous dispersion. A separately prepared aqueous solution comprised of 53.1 grams of polyvinyl alcohol (VINOL TM 523, commercially available from Air Products) in 116 killigrams of deionized water at 25° C. was then pumped into the first 50 gallon reaction vessel. Thereafter, the above prepared magnetic iron oxide dispersion was dispersed into the aqueous phase for 4 minutes by means of the IKA mixer rotating at 3,600 rpm, and a scrapper blade agitator rotating in an opposite direction at 40 rpm. The resulting oil-in-water suspension has an average oil particle diameter of 23 microns as determined by a Coulter Counter. To this suspension another solution of 3.75 killigrams of diethyl triamine (99 percent grade, commercially available from Dow Chemical Company) in 10 killigrams of water was added while the scrapper blade agitator was stirring alone at 40 rpm. The interfacial reaction to form the polyurea shell was continued for 60 minutes at room temperature and low stirring speed. Subsequently, a free radical polymerization of lauryl methacrylate was initiated by gradually raising the temperature to 85° C. and maintaining this temperature for 3.5 hours. After completion of core polymerization the suspension was cooled to 25° C., and any residual diethyl triamine and polyvinyl alcohol were removed by repeated washing with deionized water in a centrifuge until the effluent was clean and neutral about 7 in pH. About 25 killigrams of wet toner cakes, which contained about 13 percent water, and 87 percent solid toner particles obtained from the centrifuge was placed in the product container of a fluidized bed dryer made by Dairy Equipment Company. The toner particles were fluidized and dried at 300 SCFM of heated (80° C.) air for 10 minutes. The dried toner was then screened through a 170 mesh screen to remove coarse particles. The surface moisture of dried toner was 0.55 percent as measured with a Karl Fischer coulometer with oven.

One hundred parts of the above prepared dried toner were first blended with 0.8 part of BLACK PEARLS TM 2000 carbon black in a Lightnin Labmaster blender for 2 minutes at a tumbling speed of 30 rpm and an impeller speed of 3,500 rpm. Thereafters, 1.5 parts of zinc stearate were introduced and the mixture was blended at the same tumbling speed and a lower impeller speed of 3,000 rpm for 12 minutes. The toner obtained had a uniform resistivity of $4.8\times10^5$ ohm-cm as measured in a 1 $cm^3$ cell test fixture at 10 volts. The resulting encapsulated toner was then tested in a Xerox Corporation 4060 TM ionographic cold pressure fix printer. The known scotch tape test for image fix quality showed an initial fix level of about 25.9 percent, a final fix level of 75.7 percent, and an optical density of 1.68 which was measured using an optical reflection densitometer (Model Rc+, Tobias Associates, Inc.). The prints had excellent quality with little background.

EXAMPLE II

An encapsulated toner was prepared by repeating the procedure of Example I with the exception that the toner cakes were placed in a vacuum tray oven at 75° C. for 9 hours. After drying, the toner was screened through a 170 mesh screen to remove coarse particles. The surface moisture of the resulting toner was 0.34 percent.

One hundred parts of the dried toner were first blended with 0.7 part of BLACK PEARLS 2000 TM carbon black in a Lightnin Labmaster blender for 2 minutes at a tumbling speed of 30 rpm and an impeller speed of 3,500 rpm. Afterwards, 1.5 parts of zinc stearate were introduced and the mixture was blended at the same tumbling speed but a lower impeller speed at 3,000 rpm for 14 minutes. The toner obtained had a uniform resistivity of $4.5\times10^5$ ohm-cm. This encapsulated toner was then tested in a Xerox Corporation 4060 TM ionographic cold pressure fix printer. The known scotch tape test for image fix quality showed an initial fix level of about 26.8 percent, a final fix level of 80.6 percent, and an optical density of 1.63. The quality of the prints was judged excellent.

Comparative Examples were also accomplished primarily to compare the toners of the present invention with those obtained according to the spray drying and dry blending processes disclosed in U.S. Pat. No. 4,877,706.

EXAMPLE III

Comparison

An encapsulated toner was prepared by repeating the procedure of Example I with the exception that after the washing step the toner cakes were diluted with deionized water to a 30 percent solid suspension, followed by addition of 1.2 percent of a conductive graphite (AQUADAG E TM) and then spray dried with a Bowen No. 1 Tower spray dryer at an inlet air temperature of 140° C., an air flow rate of 250 SCFM and at a drying rate of about 4 killigrams per hour. The AQUADAG E TM coated encapsulated toner was then further blended with 0.51 part of BLACK PEARLS 2000 TM carbon black and 1.5 parts of zinc stearate according to the blending procedure of Example I. Similar print tests as those of Example I were accomplished in a Xerox Corporation 4060 TM printer. The scotch tape test showed an initial fix level of about 21.0 percent, a final fix level of about 63.0 percent and an optical density of 1.56.

A fluidized bed dryer can generate an encapsulated toner at a higher capacity, at less energy consumption for water removal with the elimination of AQUADAG E TM coating. Overall, the fluidized bed drying provides a more economical, that is the savings in terms of thermal energy were 1,160 k cal per killigrams of toner as compared to the above spray drying process.

EXAMPLE IV

Comparison

An encapsulated toner was prepared by repeating the procedure of Comparison Example III with the exception that a small Yamato DL-41 spray dryer at an air inlet temperature of 160° C. and an air exit temperature of 65° C. and an atomizing pressure of 1.2 killigrams/cm$^2$ was selected. Upon cooling down to room temperature, the dried toner was blended in a Labmaster blender with 0.7 part of BLACK PEARLS 2000 TM carbon black for 2 minutes at a tumbling speed of 30 rpm and an impeller speed of 3,500 rpm. The resulting mixture had a resistivity value of $4.2\times10^3$ ohm-cm. Subsequently, 1.5 parts of zinc stearate were added to the mixture and blending was carried out at a tumbling speed of 30 rpm and an impeller speed of 3,000 rpm. The toner resistivity immediately increased to a value greater than $1\times10^{11}$ ohm-cm and the mixture remained insulative during and after 18 minutes of further blending. This example indicates that for spray dried toner a prior coating of a conductive layer of AQUADAG E TM would facilitate the subsequent blending of carbon black. Without AQUADAG E TM coating, the carbon black will have difficulty attaching to the spray dried toner thus preventing the toner from acquiring the proper conductivity.

Other modifications of the present invention may occur to those skilled in the art subsequent to a review of the present application. These modifications, including equivalents thereof, are intended to be included within the scope of the present invention.

What is claimed is:

1. A process for the preparation of encapsulated toners which comprises blending core momomer or monomers, free radical initiator, pigment, and an oil soluble shell monomer; dispersing the resulting mixture in a stabilized aqueous suspension; thereafter subjecting the stabilized droplets to a shell forming interfacial polycondensation reaction by adding a water soluble shell monomer or monomers; subsequently forming the core resin binder by heat induced free radical polymerization within the newly formed capsules; washing the toner suspension; subsequently removing water therefrom in a fluidized bed dryer to obtain a dry encapsulated toner with a surface moisture content of about 0.3 percent by weight to about 0.8 percent by weight; and thereafter blending the encapsulated toner with surface additives.

2. A process in accordance with claim 1 wherein the surface additives are comprised of carbon black and a metal salt of a fatty acid.

3. A process in accordance with claim 2 wherein the metal salt of a fatty acid is zinc stearate.

4. A process in accordance with claim 2 wherein the carbon black and a metal salt of a fatty acid are added sequentially.

5. A process in accordance with claim 4 wherein a conductive carbon black is selected.

6. A process in accordance with claim 1 wherein the surface additives are comprised of carbon black, a metal salt of a fatty acid and a release component.

7. A process in accordance with claim 6 wherein the carbon black, the metal salt of a fatty acid, and the release component are added sequentially.

8. A process in accordance with claim 1 wherein the water is removed in a fluidized bed dryer in a period of from about 10 to about 20 minutes.

9. A process in accordance with claim 1 wherein the shell is pressure rupturable and the core is pressure fixable.

10. A process in accordance with claim 1 wherein the fluidized bed dryer comprises an air distribution device, a product container, an expansion chamber and filter bags, and a means to heat the entering air to facilitate the removal of water from the toner particles.

11. A process in accordance with claim 1 wherein the blending is accomplished in a mixer with an agitating impeller/chopper speed of from about 2,000 to about 5,000 revolutions per minute, a peripheral speed of from about 0.8 meter/second to about 3.0 meters/second, and a tumbling/plowing speed of from about 10 to about 200 revolutions per minute.

12. A process in accordance with claim 1 wherein the toner conductivity is from about $10^{-8}$ to about $10^{-2}$ ohm-cm$^{-1}$.

13. A process in accordance with claim 12 wherein one of the surface additives is a conductive carbon black.

14. A process in accordance with claim 13 wherein the conductive carbon black is present in an amount of from about 0.2 to about 2 percent by weight, and is blended in the toner a period of time of from about 1 minute to about 5 minutes in a mixer at an agitation speed of from about 3,000 to about 5,000 revolutions per minute.

15. A process in accordance with claim 13 wherein the toner volume resistivity thereof is from about $1\times10^3$ to about $1\times10^8$ ohm-cm.

16. A process in accordance with claim 15 wherein the toner resistivity remains unchanged subsequent to agitation at a mixing speed of 1,500 revolutions per minute.

17. A process in accordance with claim 1 wherein one of the surface additives is a release agent selected from the group consisting of metal salts of fatty acids and colloidal silicas.

18. A process in accordance with claim 17 wherein zinc stearate is selected.

19. A process in accordance with claim 18 wherein the zinc stearate is present in an amount of from about 0.5 to about 5 percent by weight, and is blended in the toner a period of time of from about 5 minutes to about 50 minutes in a mixer at an agitation speed of from about 2,000 to about 5,000 revolutions per minute.

20. A process in accordance with claim 19 wherein the toner resistivity increases rapidly from about $1\times10^2$ to $5\times10^3$ ohm-cm to about $1\times10^4$ to $1\times10^5$ ohm-cm following the addition of zinc stearate, and retained a resistivity of from $1\times10^4$ to $1\times10^5$ ohm-cm during blending and subsequently increased to about $1\times10^5$ to $1\times10^8$ ohm-cm.

21. A process in accordance with claim 1 wherein the surface additives are present in an amount of from about 0.05 to about 5 percent by weight.

22. A process in accordance with claim 1 wherein one surface additive comprised of carbon black is selected.

23. A process in accordance with claim 1 wherein the polymeric shell is a polyurea, a polyurethane, a polyamide, a polyester, or a liquid crystalline thermotropic polymer.

24. A process in accordance with claim 1 wherein the core monomer for formation of the core polymer is selected from the group consisting of n-butyl acrylate, s-butyl acrylate, isobutyl acrylate, butyl methacrylate, s-butyl methacrylate, isobutyl methacrylate, benzyl acrylate, benzyl methacrylate, propyl acrylate, isopropyl acrylate, hexyl acrylate, cyclohexyl acrylate, hexyl methacrylate, cyclohexyl methacrylate, lauryl acrylate, lauryl methacrylate, pentyl acrylate, pentyl methacrylate, stearyl acrylate, stearyl methacrylate, ethoxypropyl acrylate, ethoxypropyl methacrylate, heptyl acrylate, heptyl methacrylate, methylbutyl acrylate, methylbutyl methacrylate, m-tolyl acrylate, styrene, dodecyl styrene, hexylmethyl styrene, nonyl styrene, tetradecyl styrene, and mixtures thereof.

25. A process in accordance with claim 1 wherein water is removed by heating at a temperature of from about 50° to about 200° C.

26. A process in accordance with claim 1 wherein subsequent to washing a quantity of water is removed to enable toner cakes with from about 5 to about 15 percent by weight of water.

27. A process in accordance with claim 26 wherein removal of water or dewatering is accomplished by centrifugation.

28. A process in accordance with claim 1 wherein the pigment is carbon black, magnetite, or mixtures thereof.

29. A process in accordance with claim 1 wherein the pigment is selected from the group consisting of Heliogen Blue, Pylam Oil Blue, Pylam Oil Yellow, Pigment Blue, Pigment Violet, Pigment Red, Lemon Chrome Yellow, Bon Red, NOVAperm, Yellow FGL, Hostaperm Pink, 2,9-dimethyl-substituted quinacridone, Dispersed Red, Solvent Red, copper tetra-(octadecyl sulfonamido) phthalocyanine, copper phthalocyanine, diarylide yellow 3,3-dichlorobenzidene acetoacetanilides, a nitrophenyl amine sulfonamide, Dispersed yellow 2,5-dimethoxy-4-sulfonanilide phenylazo-4'-chloro-2,5-dimethoxy acetoacetanilide, and Permanent Yellow FGL.

* * * * *